US009534478B2

(12) United States Patent
Corre

(10) Patent No.: US 9,534,478 B2
(45) Date of Patent: Jan. 3, 2017

(54) PERFORATING PACKER CASING EVALUATION METHODS

(71) Applicant: Schlumberger Technology Corporation, Sugar Land, TX (US)

(72) Inventor: Pierre-Yves Corre, Eu (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 228 days.

(21) Appl. No.: 14/136,364

(22) Filed: Dec. 20, 2013

(65) Prior Publication Data

US 2015/0176392 A1 Jun. 25, 2015

(51) Int. Cl.

| | |
|---|---|
| ***E21B 33/12*** | (2006.01) |
| ***E21B 43/116*** | (2006.01) |
| ***E21B 47/005*** | (2012.01) |
| ***E21B 33/124*** | (2006.01) |
| ***E21B 34/14*** | (2006.01) |
| ***E21B 47/00*** | (2012.01) |
| ***E21B 47/10*** | (2012.01) |
| ***E21B 49/08*** | (2006.01) |

(52) U.S. Cl.

CPC ..... *E21B 43/116* (2013.01); *E21B 33/1243* (2013.01); *E21B 34/14* (2013.01); *E21B 47/0005* (2013.01); *E21B 47/1025* (2013.01); *E21B 49/08* (2013.01)

(58) Field of Classification Search

CPC ..... E21B 47/06; E21B 33/124; E21B 43/116; E21B 33/1285; E21B 43/112; E21B 43/11; E21B 49/08; E21B 43/117; E21B 47/0005; E21B 47/1025; E21B 34/14

See application file for complete search history.

(56) References Cited

U.S. PATENT DOCUMENTS

| | | | | |
|---|---|---|---|---|
| 2,441,894 | A | 5/1948 | Mennecier | |
| 2,690,123 | A * | 9/1954 | Kanady | E21B 43/117 175/4.52 |
| 3,181,608 | A | 5/1965 | Palmer | |
| 6,988,557 | B2 | 1/2006 | Whanger et al. | |
| 7,665,356 | B2 | 2/2010 | Ramakrishan et al. | |
| 7,699,124 | B2 | 4/2010 | Corre et al. | |
| 7,753,118 | B2 | 7/2010 | Ramakrishnan et al. | |
| 7,753,121 | B2 | 7/2010 | Whitsitt et al. | |
| 7,775,279 | B2 | 8/2010 | Marya et al. | |
| 7,921,714 | B2 | 4/2011 | Duguid et al. | |
| 7,984,761 | B2 | 7/2011 | Chang et al. | |
| 7,997,353 | B2 * | 8/2011 | Ochoa | E21B 43/103 166/297 |

(Continued)

OTHER PUBLICATIONS

Office Action Issued in U.S. Appl. No. 14/136,798, Jun. 3, 2016. 8 Pages.

*Primary Examiner* — Michael Wills, III

(74) *Attorney, Agent, or Firm* — Kenneth L. Kincaid

(57) ABSTRACT

Packers may be inflated within the wellbore to engage and isolate a portion of the wellbore casing. Charges included within the packers may then be fired to perforate the casing. According to certain embodiments, the charges may be located within drains in the packers that can be subsequently employed to induce and measure pressure changes within the casing and surrounding formation. The pressure measurements in turn can be used to determine the integrity and/or permeability of the casing.

17 Claims, 4 Drawing Sheets

(56) References Cited

U.S. PATENT DOCUMENTS

| | | | | |
|---|---|---|---|---|
| 8,091,634 | B2 * | 1/2012 | Corre | E21B 49/10 166/100 |
| 8,162,052 | B2 * | 4/2012 | Goodwin | E21B 33/127 166/165 |
| 8,794,335 | B2 * | 8/2014 | Fadul | E21B 43/117 166/376 |
| 9,181,771 | B2 | 11/2015 | Corre et al. | |
| 2007/0151724 | A1 | 7/2007 | Ohmer et al. | |
| 2009/0301635 | A1 * | 12/2009 | Corre | B29C 35/0227 156/84 |
| 2010/0071898 | A1 | 3/2010 | Corre et al. | |
| 2010/0157737 | A1 * | 6/2010 | Miller | E21B 33/124 367/117 |
| 2011/0107830 | A1 | 5/2011 | Fields et al. | |
| 2011/0277999 | A1 | 11/2011 | Corre et al. | |
| 2015/0176406 | A1 | 6/2015 | Corre et al. | |

* cited by examiner

PERFORATING PACKER CASING EVALUATION METHODS

BACKGROUND OF THE DISCLOSURE

Sequestration, otherwise known as geo-sequestration or geological storage, involves injecting a material, such as carbon dioxide, directly into underground geological formations. Declining oil fields, saline aquifers, and un-minable coal seams may serve as potential storage sites. For example, $CO_2$ may be injected into declining oil fields to increase oil recovery. The geological barrier that prevents upward migration of oil also may serve as a long-term barrier to contain the injected $CO_2$. To inhibit leakage at the injection wells, or other wells where potential leakage can occur such as current or disused production wells and/or monitoring wells, isolating cement is provided in the annular region between the well casing and the subterranean formations.

SUMMARY

The present disclosure relates to a method that includes perforating a casing with a charge disposed in a packer engaged with the casing. The method further includes measuring a pressure response through an inlet of the packer.

The present disclosure also relates to a method that includes inflating a first packer to isolate a first zone of a casing and inflating a second packer to isolate a second zone of the casing. The method also includes perforating the casing with a first charge disposed in the first packer and with a second charge disposed in the second packer. The method further includes inducing a pressure change in the casing using the first packer.

The present disclosure further relates to a method that includes perforating a casing with a charge disposed in a packer engaged with the casing. The method also includes inducing a pressure change in the casing through an inlet of the packer.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

It is to be understood that the present disclosure provides many different embodiments, or examples, for implementing different features of various embodiments. Specific examples of components and arrangements are described below to simplify the present disclosure. These are, of course, merely examples and are not intended to be limiting.

The present disclosure relates to packers that can be employed to evaluate the integrity and/or permeability of wellbore casings. According to certain embodiments, the packers may be conveyed within a wellbore on a wireline, drillstring, coiled tubing, or other suitable conveyance. The packers may be inflated within the wellbore to engage and isolate a portion of the wellbore casing. Charges included within the packers may then be fired to perforate the casing. According to certain embodiments, the charges may be located within drains in the packers that can be subsequently employed to induce and measure pressure changes within the casing and surrounding formation. In other embodiments, adjacent drains may be employed to induce and measure pressure changes within the casing and surrounding formation. The pressure measurements in turn can be used to determine the integrity and permeability of the casing.

Figure 1:
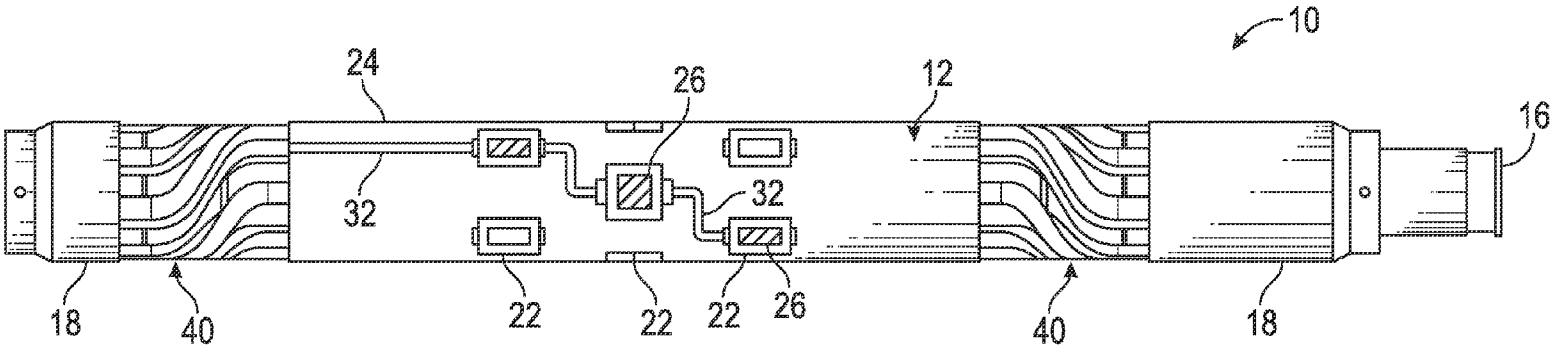
FIG. 1 is a front view of an embodiment of a perforating packer, according to aspects of the present disclosure.
Figure 2:
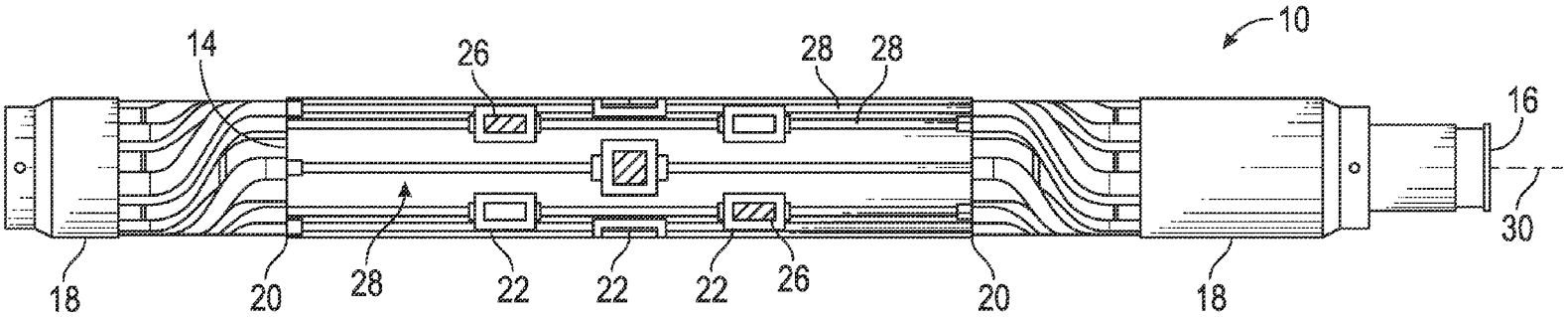
FIG. 2 is a front view of the embodiment of the perforating packer of FIG. 1 showing the internal components of an outer structural layer, according to aspects of the present disclosure.

FIGS. 1 through 4 depict an embodiment of a perforating packer 10 that can be employed to evaluate a wellbore casing. As shown in FIG. 1, the packer 10 includes an outer structural layer 12 that is expandable in a wellbore to form a seal with the surrounding wellbore wall or casing. Disposed within an interior of the outer structural layer 12 is an inner, inflatable bladder 14 disposed within an interior of the outer structural layer 12. For ease of illustration, FIG. 2 depicts the packer 10 with the outer portion of the outer structural layer 12 removed to show the internal components of the outer structural layer 12 and the inflatable bladder 14. The inflatable bladder 14 can be formed in several configurations and with a variety of materials, such as a rubber layer having internal cables. In one example, the inflatable bladder 14 is selectively expanded by fluid delivered via an inner mandrel 16. The packer 10 also includes a pair of mechanical fittings 18 that are mounted around the inner mandrel 16 and engaged with axial ends 20 of the outer structural layer 12.

The outer structural layer 12 includes one or more drains 22, or inlets, through which fluid may be drawn into the packer from the subterranean formation. Further, in certain embodiments, fluid also may be directed out of the packer 10 through the drains 22. The drains 22 may be embedded radially into a sealing element or seal layer 24 that surrounds the outer structural layer 12. By way of example, the seal layer 24 may be cylindrical and formed of an elastomeric material selected for hydrocarbon based applications, such as a rubber material. As shown in FIG. 2, tubes 28 may be operatively coupled to the drains 22 for directing the fluid in an axial direction to one or both of the mechanical fittings 18. The tubes 28 may be aligned generally parallel with a packer axis 30 that extends through the axial ends of outer structural layer 12. The tubes 28 may be at least partially embedded in the material of sealing element 24 and thus may move radially outward and radially inward during expansion and contraction of outer layer 12.

Perforating charges 26 may be mounted in one or more of the drains 22. According to certain embodiments, the perforating charges may be encapsulated shape charges, or other suitable charges. A detonating cord 32 may be disposed along the surface of the seal layer 24 and coupled to the charges 26 to fire the charges in response to stimuli, such as an electrical signal, a pressure pulse, an electromagnetic signal, or an acoustic signal among others. The detonating cord 32 may extend along the seal layer to one of the mechanical fittings 18. In other embodiments, rather than extending along the surface of the seal layer 24, the detonating cord 32 may be disposed within one or more of the tubes 28 and may be coupled to a perforating charge 26 through the interior of the respective drain 22. As shown in FIG. 1, perforating charges 26 are mounted in some of the drains 22, while other drains 22 do not include perforating charges. However, in other embodiments, perforating charges 26 may be mounted in each of the drains. Further, in other embodiments, the arrangement and number of drains 22 that include perforating charges 26 may vary. For example, in certain embodiments, radially alternating drains 22 may include perforating charges 26.

Figure 3:
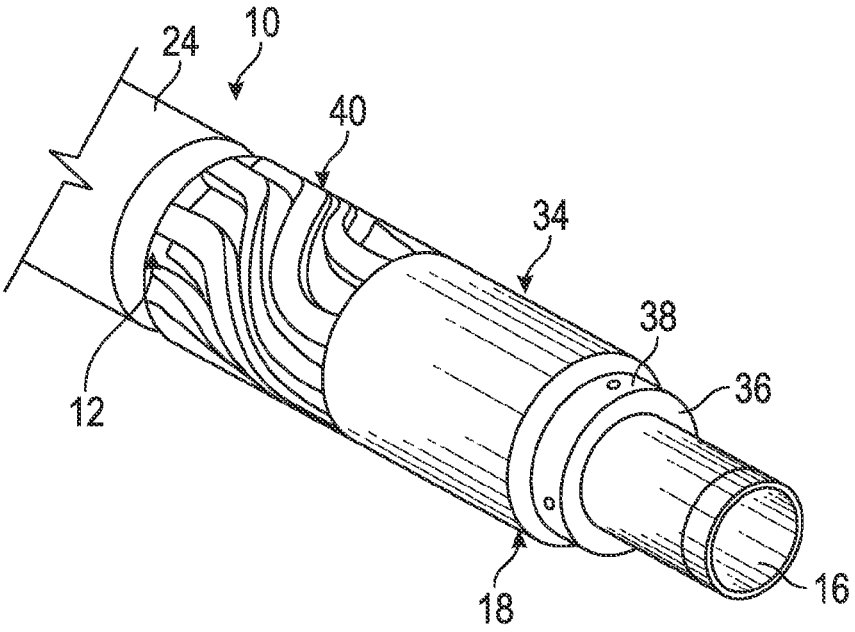
FIG. 3 is a perspective view of an end of the perforating packer of FIG. 1 in a contracted position, according to aspects of the present disclosure.
Figure 4:
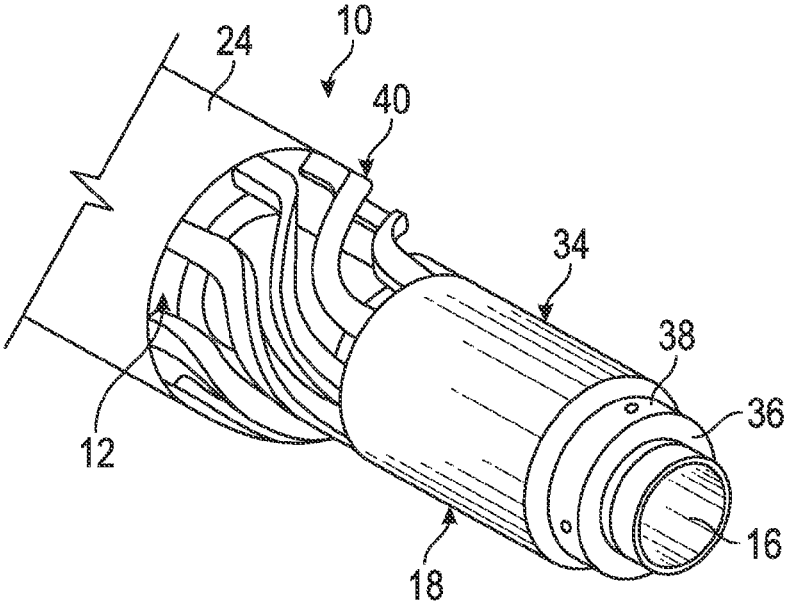
FIG. 4 is a perspective view of an end of the perforating packer of FIG. 1 in an expanded position, according to aspects of the present disclosure.

FIGS. 3 and 4 depict the mechanical fittings 18 in the contracted position (FIG. 3) and the expanded position (FIG. 4). Each mechanical fitting 18 includes a collector portion 34 having an inner sleeve 36 and an outer sleeve 38 that are sealed together. Each collector portion 34 can be ported to deliver fluid collected from the surrounding formation to a flowline within the downhole tool. One or more movable members 40 are movably coupled to each collector portion 34, and at least some of the movable members 40 are used to transfer collected fluid from the tubes 28 into the collector portion 34. By way of example, each movable member 40 may be pivotably coupled to its corresponding collector portion 34 for pivotable movement about an axis generally parallel with packer axis 30.

In the illustrated embodiment, multiple movable members 40 are pivotably mounted to each collector portion 34. The movable members 40 are designed as flow members that allow fluid flow between the tubes 28 and the collector portions 34. In particular, certain movable members 40 are coupled to certain tubes 28 extending to the drains 22, allowing fluid from the drains 22 to be routed to the collector portions 34. Further, in certain embodiments, the movable members 40 also may direct fluid from the collector portions 34 to the tubes 28 to be expelled from the packer 10 through the drains 22. The movable members 40 are generally S-shaped and designed for pivotable connection with both the corresponding collector portion 34 and the corresponding tubes 28. As a result, the movable members 40 can be pivoted between the contracted configuration illustrated in FIG. 3 and the expanded configuration illustrated in FIG. 4.

Figure 5:
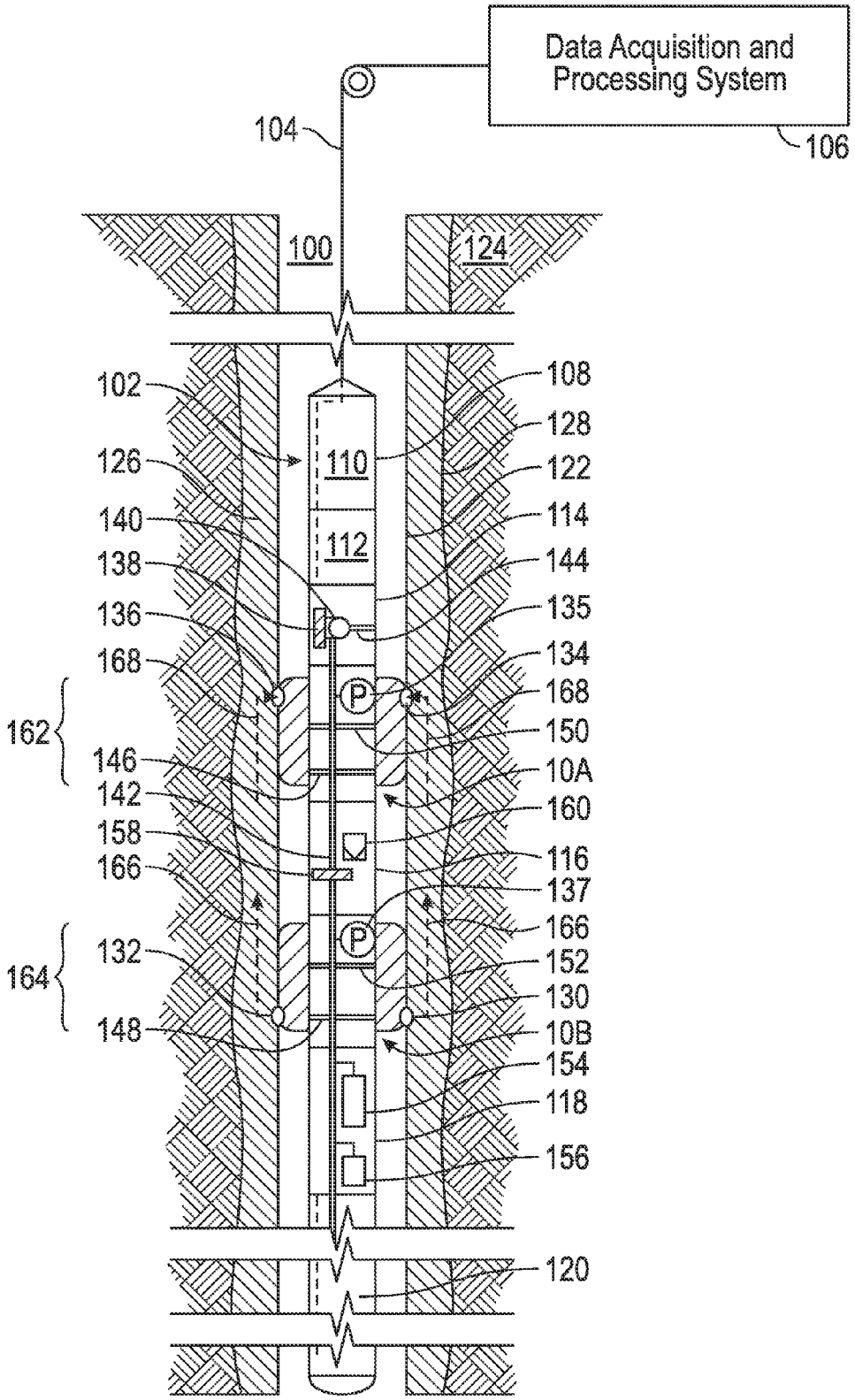
FIG. 5 is a schematic view of an embodiment of a wellsite system that may employ perforating packers, according to aspects of the present disclosure.

FIG. 5 depicts a pair of perforating packers 10A and 10B disposed within a wellbore 100 as part of a downhole tool 102. For ease of illustration, the perforating packers are labeled as 10A and 10B and may each have the structure and features of the perforating packers 10 described above with respect to FIGS. 1-4. The downhole tool 102 is suspended in the wellbore 100 from the lower end of a multi-conductor cable 104 that is spooled on a winch at the surface. The cable 104 is communicatively coupled to a processing system 106. The downhole tool 102 includes an elongated body 108 that houses the packers 10A and 10B, which may be packaged as separate modules, as well as other modules 110, 112, 114, 116, 118, and 120 that provide various functionalities including fluid sampling, fluid testing, and operational control, among others. As shown in FIG. 1, the downhole tool 102 is conveyed on a wireline (e.g., using the multi-conductor cable 104); however, in other embodiments the downhole tool may be conveyed on a drill string, coiled tubing, wired drill pipe, or other suitable types of conveyance.

The wellbore 100 is positioned within a subterranean formation 124 and includes a casing 122. An annular region 126 is defined by the outside surface of casing 122 and the outer surface 128 of the formation 124. The annular region 126 is filled primarily with an isolating cement, but also may include defects such as impurities, cracks and other pathways that may impact the average permeability of the annular region. As shown in FIG. 5, the packers 10A and 10B are radially expanded to form a seal against the casing 122 in zones 162 and 164, respectively. As described further below with respect to FIG. 6, the perforating packers 10A and 10B can be used to perforate the casing 122 to form perforations 130, 132, 134, and 136. The packers 10A and 10B can also be used to induce a pressure change, such as one or more pressure pulses, and to measure the pressure differences between zone 162 and 164. Each packer 10A and 10B may include one or more pressure sensors 135 and 137 that can measure the pressure of the zones, as well as fluid drawn into the packer 10A or 10B, through the perforations 130, 132, 134, and 136. The data collected from the pressure measurements can be used to establish if the cement in the annular region 126 is capable of isolation for use in connection with sequestration activity. According to certain embodiments, the data from the pressure measurements also may be employed to determine the integrity and/or permeability of the casing.

In addition to the packers 10A and 10B, the downhole tool 102 includes the firing head 112 for igniting the charges 26 included within the packers 10A and 10B. For example, the firing head 112 may respond to stimuli communicated from the surface of the well for purposes of initiating the firing of perforating charges 26. More specifically, the stimuli may be in the form of an annulus pressure, a tubing pressure, an electrical signal, pressure pulses, an electromagnetic signal, an acoustic signal. Regardless of its particular form, the stimuli may be communicated downhole and detected by the firing head 112 for purposes of causing the firing head 112 to ignite the perforating charges 26. As an example, in response to a detected fire command, the firing head 112 may initiate a detonation wave on the detonating cord 32 (FIG. 1) for purposes of firing the perforating charges 26.

The downhole tool 102 also includes the pump out module 114, which includes a pump 138 designed to provide motive force to direct fluid through the downhole tool 102. According to certain embodiments, the pump 138 may be a hydraulic displacement unit that receives fluid into alternating pump chambers and provides bi-directional pumping. A valve block 140 may direct the fluid into and out of the alternating pump chambers. The valve block 140 also may direct the fluid exiting the pump 138 through a primary flowline 142 that extends through the downhole tool 102 or may divert the fluid to the wellbore through a wellbore flowline 144. Further, the pump 138 may draw fluid from the wellbore into the downhole tool 102 through the wellbore flowline 144, and the valve block 140 may direct the fluid from the wellbore flowline 144 to the primary flowline 142. Further, fluid may be directed from the primary flowline 142 through inflation lines 146 and 148 to inflate the bladders 14 (FIG. 2), expanding the packers 10A and 10B into engagement with the casing 122. Fluid also may be directed from the primary flowline 142 through flowlines 150 and 152 and into the movable members 40 (FIG. 1) and tubes 28 to inject fluid into the casing 122 through the drains 22 and perforations 130, 132, 134, and 136 to induce pressure changes. Moreover, in other embodiments, fluid may be drawn into the downhole tool 102 through the perforations 130, 132, 134, and 136, drains 22, and tubes 28, moveable members 40 and flowlines 150 and 152 to induce pressure changes.

The downhole tool 102 further includes the sample module 118 which has storage chambers 154 and 156. According to certain embodiments, the storage chambers 154 and 156 may store fluid that can be injected into the casing through the drains 22 and perforations 130, 132, 134, and 136 to induce pressure pulses. Further, in certain embodiments, one or more of the storage chambers 154 and 156 may store cement that can be injected into the casing 122 through the drains 22 to seal the perforations 130, 132, 134, and 136 after completion of the pressure testing.

The downhole tool 102 also includes the fluid analysis module 116 that has a fluid analyzer 158, which can be employed to measure properties of fluid flowing through the downhole tool 102. For example, the fluid analyzer 158 may include an optical spectrometer and/or a gas analyzer designed to measure properties such as, optical density, fluid density, fluid viscosity, fluid fluorescence, fluid composition, oil based mud (OBM) level, and the fluid gas oil ratio (GOR), among others. One or more additional measurement devices, such as temperature sensors, pressure sensors, resistivity sensors, chemical sensors (e.g., for measuring pH or $H_2S$ levels), and gas chromatographs, may also be included within the fluid analyzer 158. In certain embodiments, the fluid analysis module 116 may include a controller 160, such as a microprocessor or control circuitry, designed to calculate certain fluid properties based on the sensor measurements. Further, in certain embodiments, the controller 116 may govern the perforating and pressure testing operations. Moreover, in other embodiments, the controller 116 may be disposed within another module of the downhole tool 102.

The downhole tool 102 also includes the telemetry module 110 that transmits data and control signals between the processing system 106 and the downhole tool 102 via the cable 104. Further, the downhole tool 102 includes the power module 120 that converts AC electrical power from surface to DC power. Further, in other embodiments, additional modules may be included in the downhole tool 200 to provide further functionality, such as resistivity measurements, hydraulic power, coring capabilities, and/or imaging, among others. Moreover, the relative positions of the modules 110, 112, 114, 116, 118, and 120 may vary.

Figure 6:
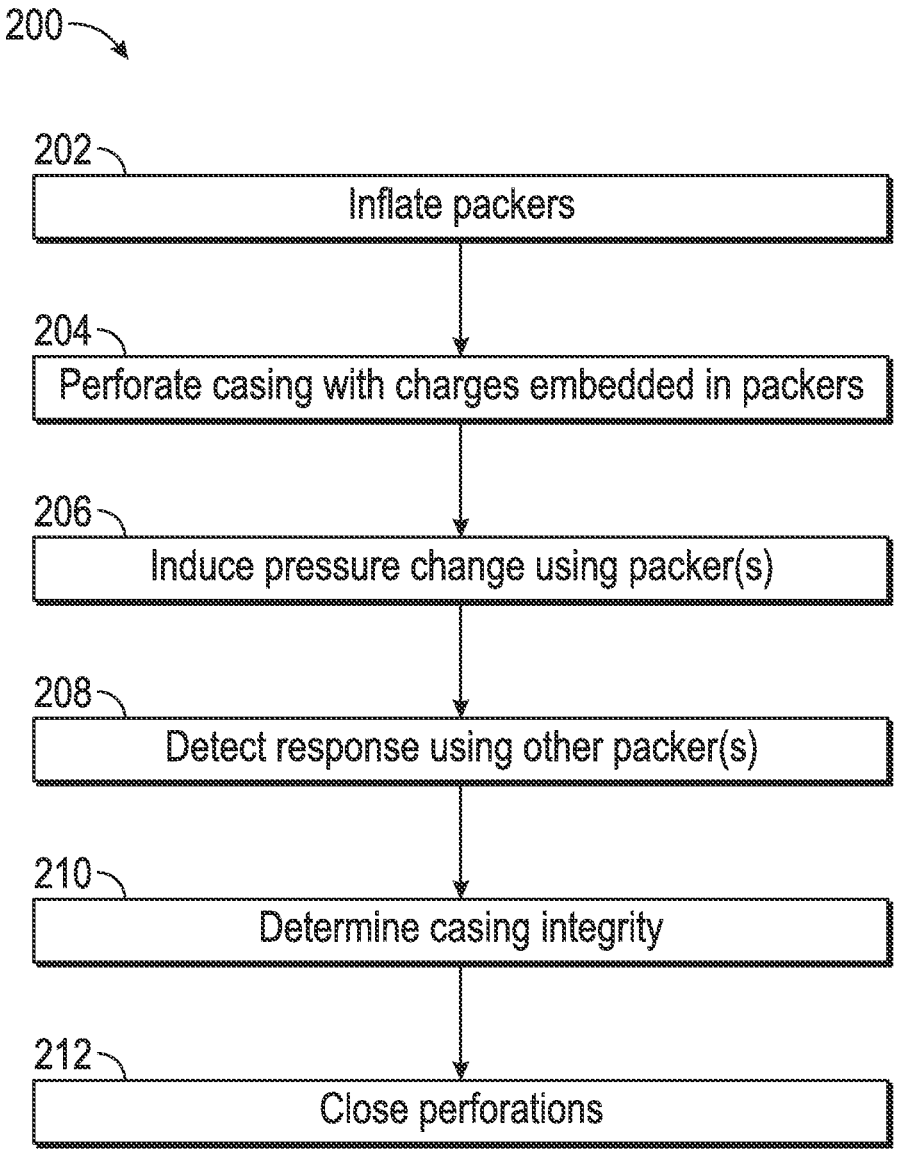
FIG. 6 is a flowchart depicting an embodiment of a method for evaluating the integrity of wellbore casings, according to aspects of the present disclosure.

FIG. 6 is a flowchart depicting an embodiment of a method 200 that may be employed to evaluate the integrity and/or permeability of wellbore casings. According to certain embodiments, the method 200 may be executed, in whole or in part, by the controller 160 (FIG. 5). For example, the controller 160 may execute code stored within circuitry of the controller 160, or within a separate memory or other tangible readable medium, to perform the method 200. Further, in certain embodiments, the controller 160 may operate in conjunction with a surface controller, such as the processing system 106 (FIG. 5), that may perform one or more operations of the method 200.

The method may begin by inflating (block 202) the packers. For example, as shown in FIG. 5, the downhole tool 102 may be conveyed to a desired location within the wellbore 100, and the packers 10A and 10B may be expanded to engage the casing 122 and isolate zones 162 and 164 of the casing 122. As shown in FIG. 5, two packers 10A and 10B are inflated; however, in other embodiments, any number of two or more packers may be inflated to isolate two or more respective zones of the casing 122. In certain embodiments, fluid may be directed into the packers 10A and 10B through the inflation flowlines 146 and 148 to expand the inflatable bladders 14 (FIG. 2).

After the packers 10A and 10B have been inflated, the casing 122 may be perforated (block 204) using the charges embedded in the packers. For example, the firing head 112 (FIG. 5) may initiate a detonation wave on the detonating cords 32 (FIG. 1) to ignite the charges 26 disposed within the drains 22 of the packers 10A and 10B. Upon ignition, the charges 22 may form the perforations 130, 132, 134, and 136. Although FIG. 5 depicts two perforations 130 and 132 or 134 and 136 within each zone 164 and 162, respectively, in other embodiments, any number of one or more perforations may be included within each zone 162 and 164.

After the casing has been perforated, the packers may be employed to induce (block 206) a pressure change, or pulse. For example, as shown in FIG. 5, packer 10B may be employed to inject fluid into the casing 122 through the perforations 130 and 132, causing fluid to flow through the annular region 126 as indicated by the arrows 166. In certain embodiments, the pump 138 may be operated to direct fluid from the wellbore 100 or from a sample chamber 154 or 154 through the primary flowline 142 and the flowline 152 to the packer 10B. Within the packer 10B, the fluid may flow through the movable members 40 and the tubes 28 to the drains 22 which direct the fluid into the perforations 130 and 132. According to certain embodiments, the fluid may be directed to the same drains 22 that included the perforating charges 26. However, in other embodiments, proximate drains 22 that did not include perforating charges 26 may be employed to direct the fluid through the perforations 130 and 132 and into the annular region 126. Further, in yet other embodiments, the pump 138 may be employed to draw fluid out of the annular region 126 through the perforations 130 and 132 and drains 22 to induce a pressure change.

The pressure response may then be detected (block 208) using one or more other packers. For example, as shown in FIG. 5, leaks or cracks in the annular region 126 may allow the fluid to flow into the perforations 134 and 136, as shown by the arrows 168. The movement of fluid may be monitored using the pressure gauge 135 in the packer 10A. In certain embodiments, the pressure may be measured prior to and/or during the pressure change, as well as after initiation of the pressure change. The pressures may be compared and used to determine the integrity and/or permeability of the casing, using techniques known to those skilled in the art. For example, an increase in pressure of a certain amount may indicate poor integrity of the casing 122. In certain embodiments, pressure measurements may also be made at the packer 10B using the pressure gauge 137 and used in conjunction with the pressures measurements from the packer 10A to determine the integrity and/or permeability of the casing.

After the pressure measurements have been completed, the perforations may be closed (block 212). For example, in certain embodiments, cement or other sealant may be injected into the perforations 130, 132, 134, and 136 using the packers 10A and 10B. As shown in FIG. 5, sealant may be stored within a storage chamber 154 or 156 and pumped to the packers 10A and 10B using the pump 138. The pump 138 may direct the sealant through the primary flowline 142 and the flowlines 150 and 152 to the movable members 40 (FIG. 1). The sealant may then flow through the tubes 28 and the drains 22 into the perforations 130, 132, 134, and 136. However, in other embodiments, a dedicated pump and flowline may be employed to direct the sealant to the packers 10A and 10B. Further, in other embodiments, the sealing process may be omitted or performed using a separate downhole tool or module.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A method comprising:

perforating a casing with a charge disposed in a packer engaged with the casing;

measuring a pressure response through an inlet of the packer; and wherein the charge is disposed in the inlet.

2. The method of claim 1, wherein perforating comprises initiating a detonating wave on a detonating cord disposed on an outer surface of the packer.

3. The method of claim 1, wherein perforating comprises initiating a detonating wave on a detonating cord disposed within a fluid tube of the packer.

4. The method of claim 1, wherein measuring comprises measuring a pressure in a flowline of the packer.

5. The method of claim 1, comprising determining an integrity of the casing based on the measured pressure response.

6. The method of claim 1, comprising initiating the pressure response through an inlet of an additional packer engaged with the casing.

7. A method comprising:

inflating a first packer to isolate a first zone of a casing;

inflating a second packer to isolate a second zone of the casing;

perforating the casing with a first charge disposed in the first packer and with a second charge disposed in the second packer, and wherein the first charge is disposed in a first drain of the first packer; and inducing a pressure change in the casing using the first packer.

8. The method of claim 7, wherein inflating the first and second packers comprises directing a wellbore fluid into inflatable bladders of the first and second packers.

9. The method of claim 7, wherein inducing the pressure change comprises directing fluid through the first drain into a perforation formed in the casing by the first charge.

10. The method of claim 7, comprising injecting a sealant through the first drain to close a perforation in the casing formed by the first charge.

11. The method of claim 7, [wherein the first charge is disposed in a first drain of the first packer and ]wherein the second charge is disposed in a second drain of the second packer.

12. The method of claim 7, wherein the second charge is disposed in a second drain of the second packer and comprising detecting a pressure response resulting from the induced pressure change through the second drain.

13. A method comprising:

perforating a casing with a charge disposed in a packer engaged with the casing;

inducing a pressure change in the casing through an inlet of the packer, and wherein the charge is disposed in the inlet.

14. The method of claim 13, wherein inducing comprises injecting a fluid into the casing through the inlet of the packer.

15. The method of claim 13, wherein inducing comprises withdrawing a fluid from the casing through an inlet of the packer.

16. The method of claim 13, wherein inducing comprises injecting a wellbore fluid into the casing through the inlet.

17. The method of claim 13, comprising detecting a pressure response resulting from the induced pressure change through an inlet of an additional packer engaged with the casing.

* * * * *